US008186660B2

(12) United States Patent
Wang

(10) Patent No.: US 8,186,660 B2
(45) Date of Patent: May 29, 2012

(54) LENS HOLDING APPARATUS WITH SUCTION

(75) Inventor: Chung-Pei Wang, Tucheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 405 days.

(21) Appl. No.: 12/535,912

(22) Filed: Aug. 5, 2009

(65) Prior Publication Data

US 2010/0123277 A1 May 20, 2010

(30) Foreign Application Priority Data

Nov. 18, 2008 (CN) ..... 2008 1 0305605

(51) Int. Cl.
*B25B 11/00* (2006.01)

(52) U.S. Cl. ..... 269/21; 269/20

(58) Field of Classification Search ..... 269/21, 269/20, 289 R, 900; 29/281.1
See application file for complete search history.

(56) References Cited

U.S. PATENT DOCUMENTS

| | | | | |
|---|---|---|---|---|
| 4,066,249 | A * | 1/1978 | Huber et al. | 269/21 |
| 6,173,648 | B1 * | 1/2001 | Misono et al. | 101/474 |
| 6,272,989 | B1 * | 8/2001 | Misono et al. | 101/474 |
| 6,439,559 | B1 * | 8/2002 | Kinnard et al. | 269/21 |
| 7,690,869 | B2 * | 4/2010 | Yo et al. | 406/88 |

* cited by examiner

*Primary Examiner* — Lee D Wilson
(74) *Attorney, Agent, or Firm* — Altis Law Group, Inc.

(57) ABSTRACT

An exemplary lens holding apparatus includes a pipe, a number of hollow lens holding units, and an air pump. The pipe has an airtight end and an air vent end. The lens holding units each are in communicate with the pipe and each include a number of first portions and a number of second portions. The first and second portions are alternately arranged and each have an inner space for communicating each other. The second portions each have a top wall and a bottom wall. The top wall has a first through hole defined therein and in communicate with the inner space of the second portion. The air pump is connected to the air vent end and configured for pumping air from the pipe, such that lenses received in the first through holes are releasably held in position.

12 Claims, 4 Drawing Sheets

LENS HOLDING APPARATUS WITH SUCTION

BACKGROUND

1. Technical Field

The present disclosure relates to lens holding apparatuses, and particularly, to a lens holding apparatus capable of holding a number of lenses by way of suction.

2. Description of Related Art

Lenses are widely used in cameras and other optical devices. Usually, an injection molding method or a press-molding method is used for molding a large quantity of the lenses in a single batch. After the molding, the lenses may have to go through other treatment processes, such as surface cleaning and film coating. As such, lens holding apparatuses are needed to carry the lenses to a location of the next process and/or to hold the lenses during the next process.

A typical lens holding apparatus includes a main body and a cover. The main body has a number of recesses formed in a top surface thereof, and the cover has corresponding through holes. The lenses are disposed in the respective recesses, and the cover is disposed on the main body, with an optical surface of each of the lenses extending through the corresponding through hole. Thus, the lens holding apparatus holds the lenses.

However, in some situations, the size of the lenses may not conform to the sizes of the recesses and the through holes. In such case, the lenses may vibrate in the lens holding apparatus. That is, the lens holding apparatus cannot steadily hold the lenses.

What is needed, therefore, is a lens holding apparatus which can overcome the above-described shortcomings.

BRIEF DESCRIPTION OF THE DRAWINGS

Many aspects of the present lens holding apparatus can be better understood with reference to the following drawings. The components in the drawings are not necessarily drawn to scale, the emphasis instead being placed upon clearly illustrating the principles of the present lens holding apparatus. Moreover, in the drawings, like reference numerals designate corresponding parts throughout the several views.

DETAILED DESCRIPTION OF EMBODIMENTS

Embodiments of the present lens holding apparatus will now be described in detail below and with reference to the drawings.

Figure 1:
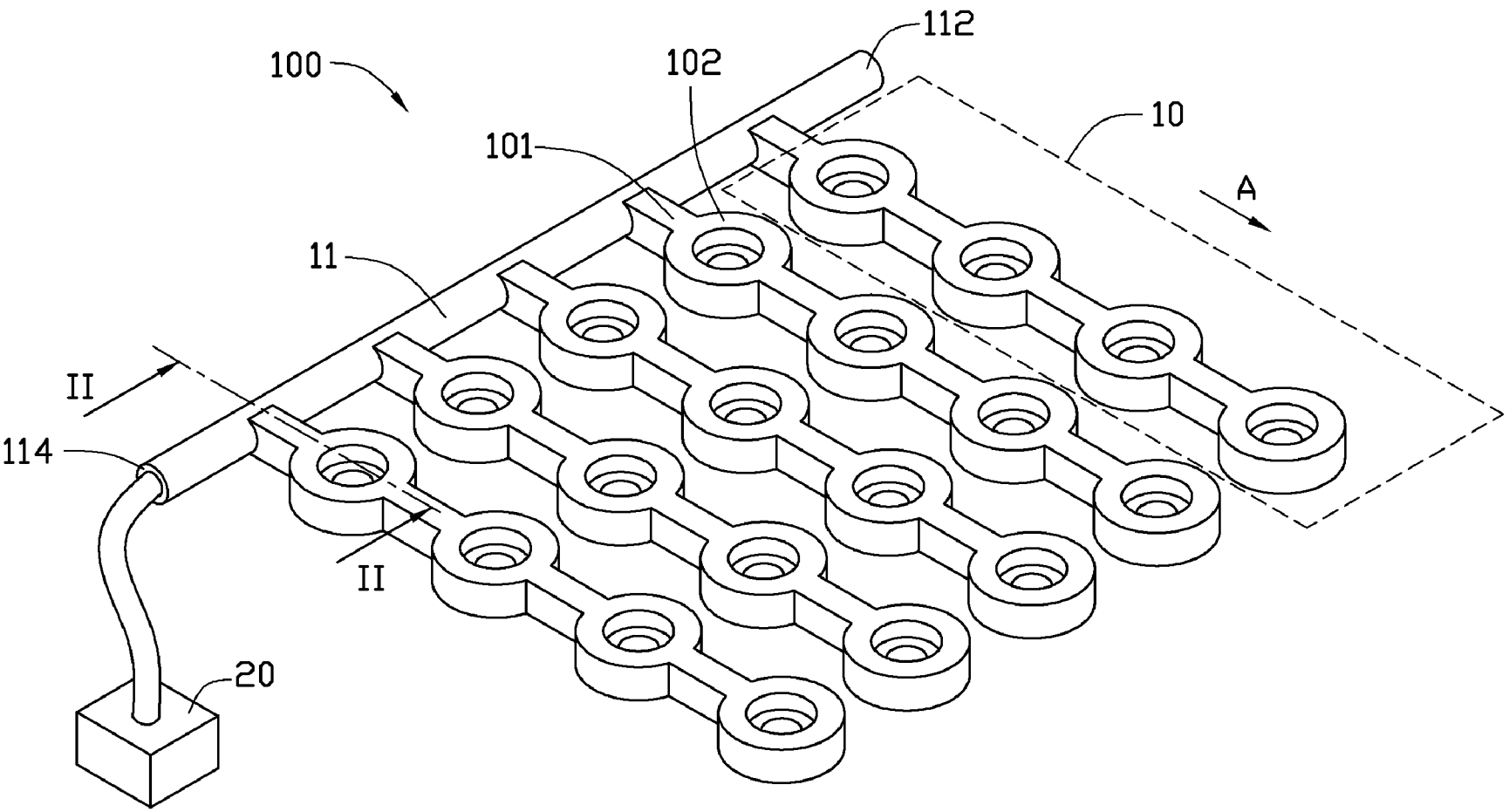
FIG. 1 is a schematic, isometric view of a lens holding apparatus in accordance with a first embodiment, the lens holding apparatus including a pipe and a number of lens holding units.
Figure 2:
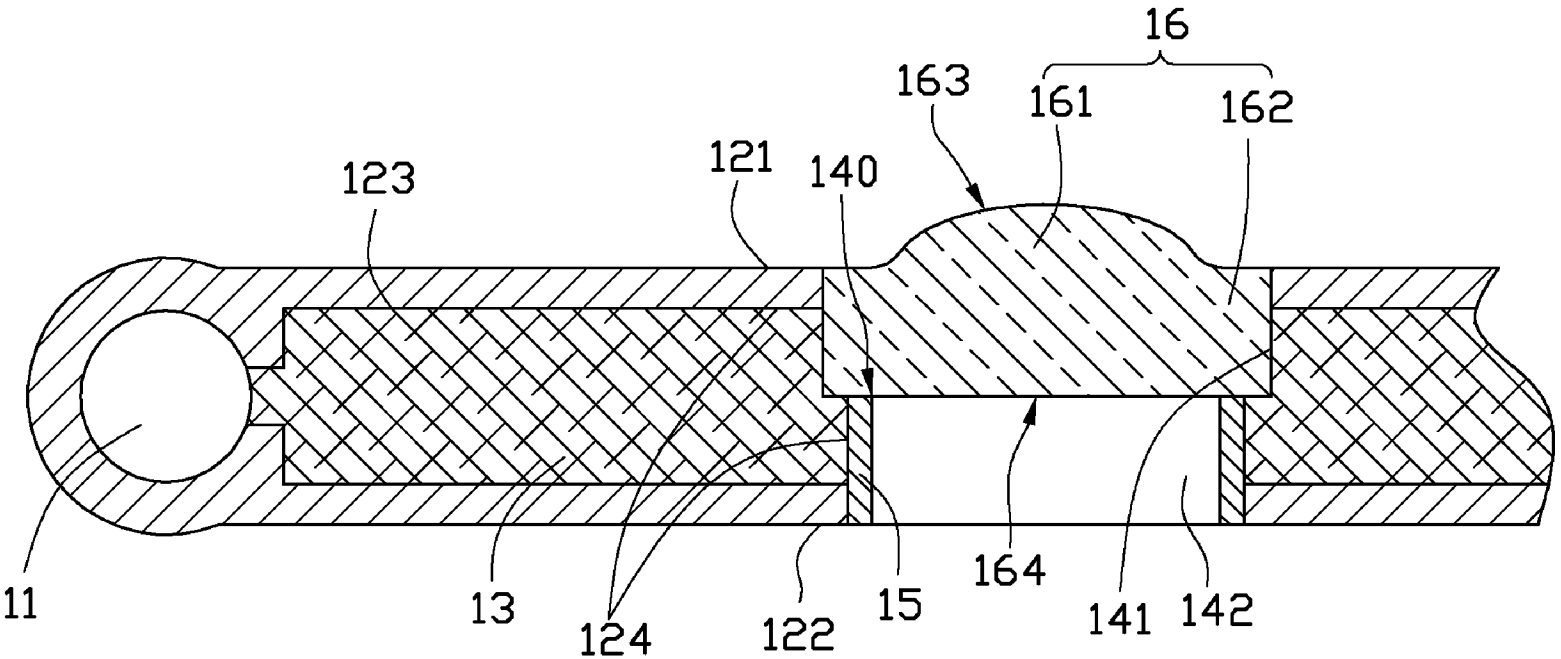
FIG. 2 is a cross-sectional view of the pipe and part of one of the lens holding units of FIG. 1, taken along line II-II thereof, and also showing a lens held by the lens holding unit.

Referring to FIGS. 1 and 2, an exemplary lens holding apparatus 100 in accordance with a first embodiment is shown. The lens holding apparatus 100 is capable of holding a number of lenses 16, and includes a pipe 11, a number of lens holding units 10, and an air pump 20. Each lens 16 includes a central optical portion 161 and a peripheral portion 162. In the present embodiment, the central optical portion 161 has a convex optical surface 163 on the top, and a flat optical surface 164 on the bottom. The peripheral portion 162 has flat surfaces (not labeled) on both the top and the bottom.

The pipe 11 has an airtight end 112 and an air vent end 114 at opposite extremities. For example, the airtight end 112 is a sealed end of the pipe 11. The air pump 20 is connected to the air vent end 114. The lens holding units 10 are arranged on a same side of the pipe 11, and are parallel to each other. In the illustrated embodiment, a hollow end of each of the lens holding units 10 is integrally formed with the pipe 11. Thus, the end of the lens holding unit 10 is in communication with the pipe 11. The lens holding unit 10 includes a number of first portions 101 and a number of second portions 102. The first portions 101 and the second portions 102 are alternately arranged in a line. Thus the second portions 102 are arranged in a line along the direction A. In the illustrated embodiment, for the lens holding apparatus 100 as a whole, the second portions 102 are arranged in a regular m×n matrix array. The first portions 101 are substantially rectangular shaped, and the second portions 102 are substantially cylindrical shaped. Each first portion 101 has an inner space 123, each second portion 102 has an inner space 124, and the inner spaces 123, 124 communicate with each other. In each lens holding unit 10, the inner spaces 123 of the first portions 101 are intercommunicated by the inner spaces 124 of the corresponding second portions 102.

Each second portion 102 includes a top wall 121 and a bottom wall 122. The top wall 121 has a first through hole 141 formed in a central region thereof. The first through hole 141 has a constant diameter, which is preferably substantially equal to or slightly greater than that of the lens 16. The first through hole 141 is in communication with the inner space 124. The bottom wall 122 has a second through hole 142 formed in a central region thereof. A diameter of the second through hole 142 is less than that of the first through hole 141. In the illustrated embodiment, an axis of the first through hole 141, an axis of the second through hole 142, and an axis of the second portion 102 are all coaxial with one another. A ring-shaped supporter 15, which is made of airtight material, is attached to the bottom wall 122 in the second through hole 142 and further extends into the inner space 124. The ring-shaped supporter 15 can be attached by means of, e.g., interferential engagement or adhesive. The lens 16 is received in the first through hole 141, and is disposed on the supporter 15. The optical surface 163 is exposed to the outside of the top wall 121. With this configuration, various treatment processes, such as surface cleaning, can be easily carried out on the optical surface 163. In a further or alternative embodiment, the optical surface 164 can be exposed to the outside of the top wall 121, such that various treatment processes can be carried out on the optical surface 164.

A porous wick structure 13 is arranged in the inner spaces 123, 124, around the lens 16 and the supporter 15. The porous wick structure 13 can abut a periphery of the lens 16. In the illustrated embodiment, the porous wick structure 13 contacts the periphery of the lens 16. Air can go through the pores of the porous wick structure 13.

When the air pump 20 pumps air from the pipe 11, the inner spaces 123, 124 form a low air pressure chamber, and an annular interface 140 between the lens 16 and the supporter 15 becomes airtight, such that the lens 16 can be steadily held in position.

When the air pump 20 pumps air into the pipe 11, or the air pump 20 disconnects from the pipe 11, the air pressure of the inner spaces 123, 124 increases until it is the same as the air pressure of the outside (ambient) environment. At that time, the lens 16 can be released from the first through hole 141.

Figure 3:
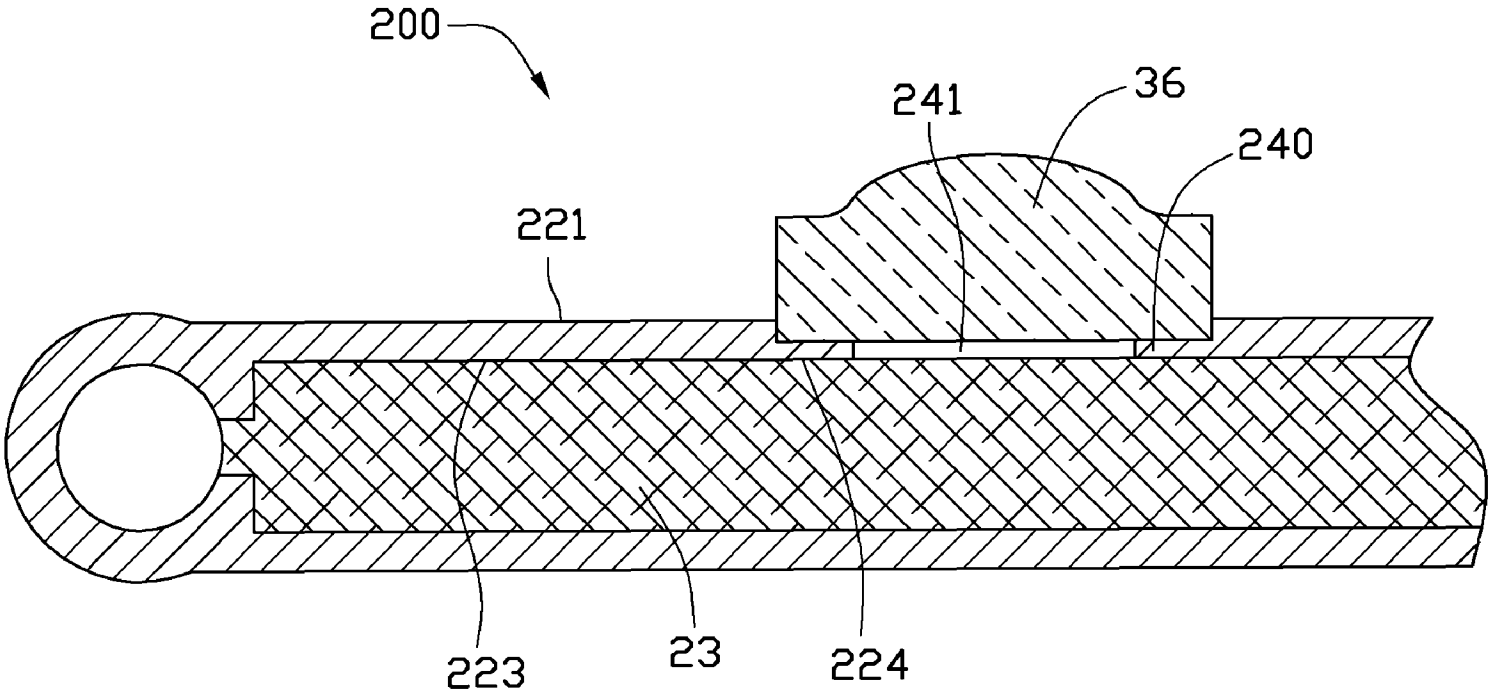
FIG. 3 is a similar to FIG. 2, but showing a pipe and part of a lens holding unit of a lens holding apparatus in accordance with a second embodiment.

Referring to FIG. 3, an exemplary lens holding apparatus 200 in accordance with a second embodiment is shown. The lens holding apparatus 200 is similar to the lens holding apparatus 100 described above. However, in the lens holding apparatus 200, a top wall 221 has a step-shaped through hole 241 formed therein. A lens 26 is retained on an annular inner step 240 of the through hole 241. A porous wick structure 23 is arranged in an inner space 223 and substantially an entirety of an inner space 224.

Figure 4:
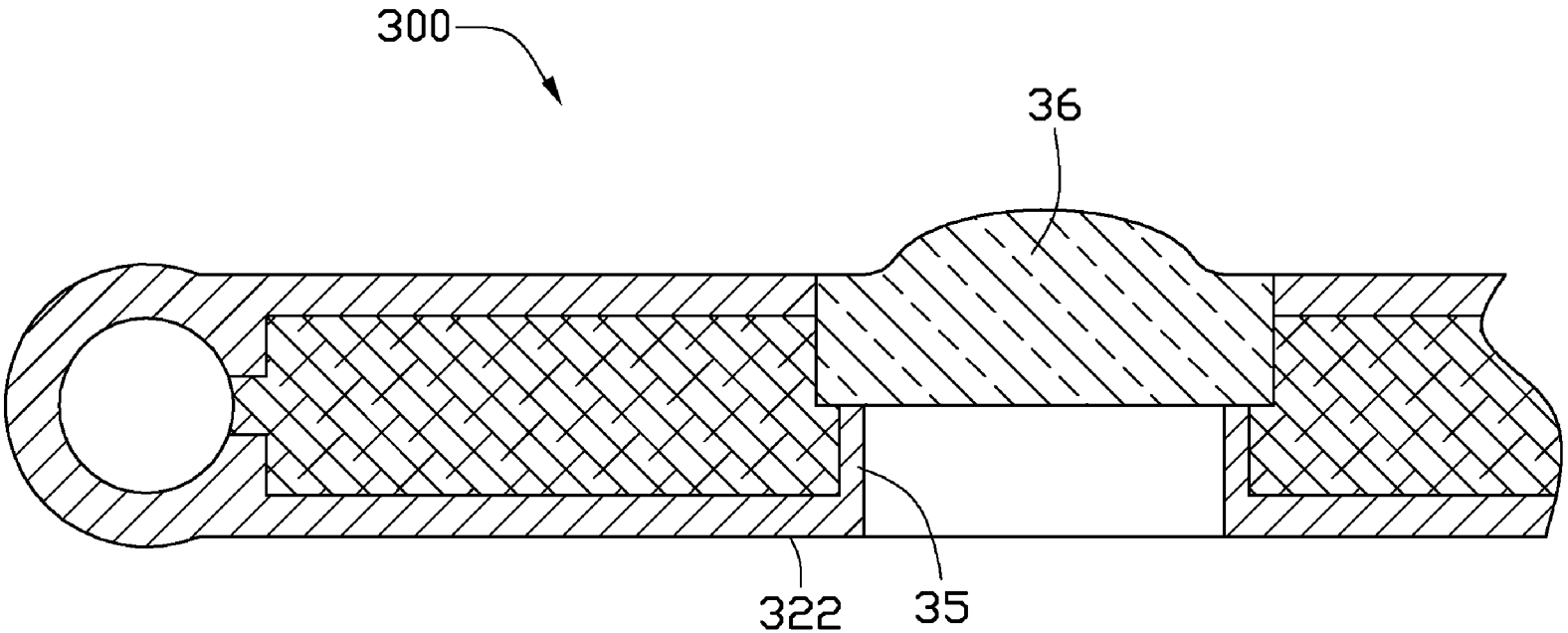
FIG. 4 is a similar to FIG. 2, but showing a pipe and part of a lens holding unit of a lens holding apparatus in accordance with a third embodiment.

Referring to FIG. 4, an exemplary lens holding apparatus 300 in accordance with a third embodiment is shown. The lens holding apparatus 300 is similar to the lens holding apparatus 100 described above. However, in the lens holding apparatus 300, a supporter 35 is integrally formed with a bottom wall 322 and also configured to support a lens 36.

It is understood that the above-described embodiments are intended to illustrate rather than limit the disclosure. Variations may be made to the embodiments without departing from the spirit of the disclosure. Accordingly, it is appropriate that the appended claims be construed broadly and in a manner consistent with the scope of the disclosure.

What is claim is:

1. A lens holding apparatus, comprising:

a pipe having an airtight end and an air vent end;

a plurality of hollow lens holding units each in communication with the pipe and each comprising a plurality of first portions and a plurality of second portions, the first and second portions being alternately arranged and each having an inner space, the inner spaces communicating each other, the second portions each having a top wall and a bottom wall, the top wall having a first through hole defined therein and configured for receiving a lens, the first through hole being in communication with the inner space of the second portion;

a porous wick structure arranged in the inner spaces of the first and second portions; and an air pump connected to the air vent end and configured for pumping air from the pipe such that lenses received in the first through holes are releasably held in position.

2. The lens holding apparatus as described in claim 1, wherein each of the second portions further has a supporter, the bottom wall has a second through hole defined therein, the supporter is located in the second through hole and extends into the inner space of the second portion, and the supporter is capable of supporting a lens received in the first through hole.

3. The lens holding apparatus as described in claim 2, wherein a diameter of the second through hole is smaller than that of the corresponding first through hole.

4. The lens holding apparatus as described in claim 2, wherein the supporter is ring-shaped, and is made of airtight material.

5. The lens holding apparatus as described in claim 2, wherein the supporter is one of integrally formed with the bottom wall and a separate piece attached to the bottom wall.

6. The lens holding apparatus as described in claim 1, wherein the first through hole is step-shaped, and the lens is capable of being retained on an inner step of the first through hole.

7. The lens holding apparatus as described in claim 1, wherein the lens holding units are arranged on a same side of the pipe, and the second portions of the lens holding units are collectively arranged in an array.

8. A lens holding apparatus for holding a plurality of lenses, the lens holding apparatus comprising:

a pipe having a sealed end and an air vent end;

a plurality of hollow lens holding units each in communication with the pipe and each comprising a plurality of first portions and a plurality of second portions, the first and second portions being alternately arranged and each having an inner space, the inner spaces communicating with each other, the second portions each having a top wall and a bottom wall, the top wall having a first through hole defined therein being in communication with the inner space of the second portion;

a porous wick structure arranged in the inner spaces of the first and second portions; and an air pump connected to the air vent end, the air pump being configured for pumping air from the pipe and the lens holding units so as to hold by suction lenses received in the respective first through holes, and being configured for equalizing air pressure in the lens holding units with air pressure in the ambient environment so as to enable release of the lenses.

9. The lens holding apparatus as described in claim 8, wherein the porous wick structure fills substantially an entirety of the inner spaces of the first and second portions.

10. The lens holding apparatus as described in claim 8, wherein the bottom wall of each second portion has a second through hole defined therein, each of the second portions further has a ring-shaped hermetic supporter located in the second through hole and configured for supporting the corresponding lens received in the corresponding first through hole, and the porous wick structure in each second portion is arranged around the supporter and configured to abut a periphery of the corresponding lens.

11. The lens holding apparatus as described in claim 10, wherein the supporter is one of integrally formed with the bottom wall and a separate piece attached to the bottom wall.

12. A lens holding apparatus, comprising:

a pipe having an airtight end and an air vent end;

a plurality of hollow lens holding units each in communication with the pipe and each comprising a plurality of first portions and a plurality of second portions, the first and second portions being alternately arranged and each having an inner space, the inner spaces communicating each other, the second portions each having a top wall, a bottom wall, and a supporter, wherein the top wall has a first through hole defined therein and configured for receiving a lens, the bottom wall has a second through hole defined therein, the first through hole is in communication with the inner space of the second portion, the supporter is ring-shaped and airtight and located in the second through hole and extends into the inner space of the second portion, the supporter is one of integrally formed with the bottom wall and a separate piece attached to the bottom wall, and the supporter is capable of supporting a lens received in the first through hole;

a porous wick structure arranged in the inner spaces of the first and second portions, and the porous wick structure in each second portion is arranged around the supporter and configured to abut a periphery of the lens received in the corresponding first through hole; and an air pump connected to the air vent end and configured for pumping air from the pipe such that lenses received in the first through holes are releasably held in position.

* * * * *